US005218405A

United States Patent [19]

Wong

[11] Patent Number: 5,218,405

[45] Date of Patent: Jun. 8, 1993

[54] PHOTORECEPTOR DRUM RUNOUT CONTROL APPARATUS

[75] Inventor: Lam F. Wong, Fairport, N.Y.

[73] Assignee: Xerox Corporation, Stamford, Conn.

[21] Appl. No.: 906,181

[22] Filed: Jun. 29, 1992

[51] Int. Cl.[5] ..... G03G 15/00

[52] U.S. Cl. ..... 355/200; 355/211

[58] Field of Search ..... 355/200, 210, 211, 233; 346/153.1, 160.1

[56] References Cited

U.S. PATENT DOCUMENTS

| | | | |
|---|---|---|---|
| 3,490,841 | 1/1970 | Cely, Jr. et al. | 355/200 |
| 3,966,316 | 6/1976 | Pfeifer et al. | 355/200 |
| 4,120,576 | 10/1978 | Babish | 355/200 |
| 4,598,992 | 7/1986 | Landa et al. | 355/211 |
| 4,876,572 | 10/1989 | Nagatsuna | 355/210 |
| 4,922,297 | 5/1990 | Kondo | 355/211 |
| 4,947,208 | 8/1990 | Komatsu et al. | 355/200 |
| 5,038,172 | 8/1991 | Schreyer | 355/211 |
| 5,086,316 | 2/1992 | Aoki | 355/200 |
| 5,136,330 | 8/1992 | Sato | 355/200 |

FOREIGN PATENT DOCUMENTS

| | | | |
|---|---|---|---|
| 0083067 | 6/1980 | Japan | 355/211 |
| 0175782 | 8/1987 | Japan | 355/211 |

*Primary Examiner*—A. T. Grimley
*Assistant Examiner*—William J. Royer
*Attorney, Agent, or Firm*—Kevin R. Kepner

[57] ABSTRACT

An apparatus for mounting a photoreceptor drum so that the imaging surface thereof remains at a substantially constant distance from an imaging source to minimize image distortion caused by drum runout. The photoreceptor drum is mounted on a rotatable supports and is resiliently urged against a guide. By urging the imaging surface of the photoreceptor drum against a rotatable guide, the imaging surface is maintained a substantially constant distance from the imaging source thereby minimizing lateral magnification error caused by drum runout.

10 Claims, 2 Drawing Sheets

PHOTORECEPTOR DRUM RUNOUT CONTROL APPARATUS

This invention relates generally to a photoreceptor drum mounting apparatus, and more particularly concerns a photoreceptor drum runout control for multiple imaging stations in a tandem architecture electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

The foregoing generally describes a typical black and white electrophotographic printing machine. With the advent of multicolor electrophotographic, it is desirable to use the so-called tandem architecture which comprises a plurality of image forming stations. This tandem architecture offers a high potential for throughput and image quality. One choice of photoreceptors in this tandem engine architecture is a drum based photoreceptor architecture used in combination with an intermediate transfer belt. To provide durability, it is desirable to use a larger diameter drum which affords more than a single pitch so as to increase drum life, number of copies per minute and copy volume. A problem with a larger drum is that the total indicated runout (being runout caused by the eccentricity of the drum) of the drum becomes larger as the diameter of the drum increases. This total indicated runout causes image registration error at each photoreceptor drum and between the multiple photoreceptor drums.

It is desirable that the multiple drum surfaces in a tandem printing machine remain at a constant distance from the imaging source. Photoreceptor drum runout causes a change in the conjugate length between the imaging source and the photoreceptor surface. This variation in conjugate length due to the drum runout can cause a lateral magnification error which precludes proper image registration when printing color copies.

The following disclosures may be relevant to various aspects of the present invention:

U.S. Pat. No. 5,038,172
Patentee—Schreyer
Issue Date—Aug. 6, 1991
U.S. Pat. No. 4,922,297
Patentee—Kondo
Issue Date—May 1, 1990
U.S. Pat. No. 4,120,576
Patentee—Babish Issue Date—Oct. 17, 1978

The relevant portions of the foregoing disclosures may be briefly summarized as follows:

U.S. Pat. No. 5,038,172 discloses a bearing for a photoconductive drum which is free of bearing play while providing easy replacement of the photoconductive drum.

U.S. Pat. No. 4,922,297 discloses a support shaft supporting a photosensitive drum detachable in the radial direction supported by a bearing. A joint integrally rotatably linked to the support shaft and the photosensitive drum shaft is disposed so as to be disconnected from either of the support shaft or the photosensitive drum drive shaft.

U.S. Pat. No. 4,120,576 discloses a drum support apparatus including an outbound and inbound hub, having outer surfaces adapted for interface fitting with the inside surface of a drum. The hubs, while being supported on a cantilevered shaft from a frame, have provisions to be secured by the tightening of a single nut at the center of a drum. The assembly creates an equal distribution of force on the hubs, thus diminishing circular runout of the drum.

In accordance with one aspect of the present invention, there is provided a drum mounting apparatus. The apparatus comprises means for guiding the drum so as to maintain the surface thereof at a substantially constant distance from a pre-selected reference location. Means for resiliently urging the drum toward said guiding means to position the drum surface in contact therewith are also provided.

Pursuant to another aspect of the present invention, there is provided An electrophotographic printing machine having a drum mounting apparatus. The drum mounting apparatus comprises means for guiding the drum so as to maintain the surface thereof at a substantially constant distance from a pre-selected reference location. Means for resiliently urging the drum toward said guiding means to position the drum surface in contact therewith are also provided.

Other features of the present invention will become apparent as the following description proceeds and upon reference to the drawings, in which.

Figure 3:
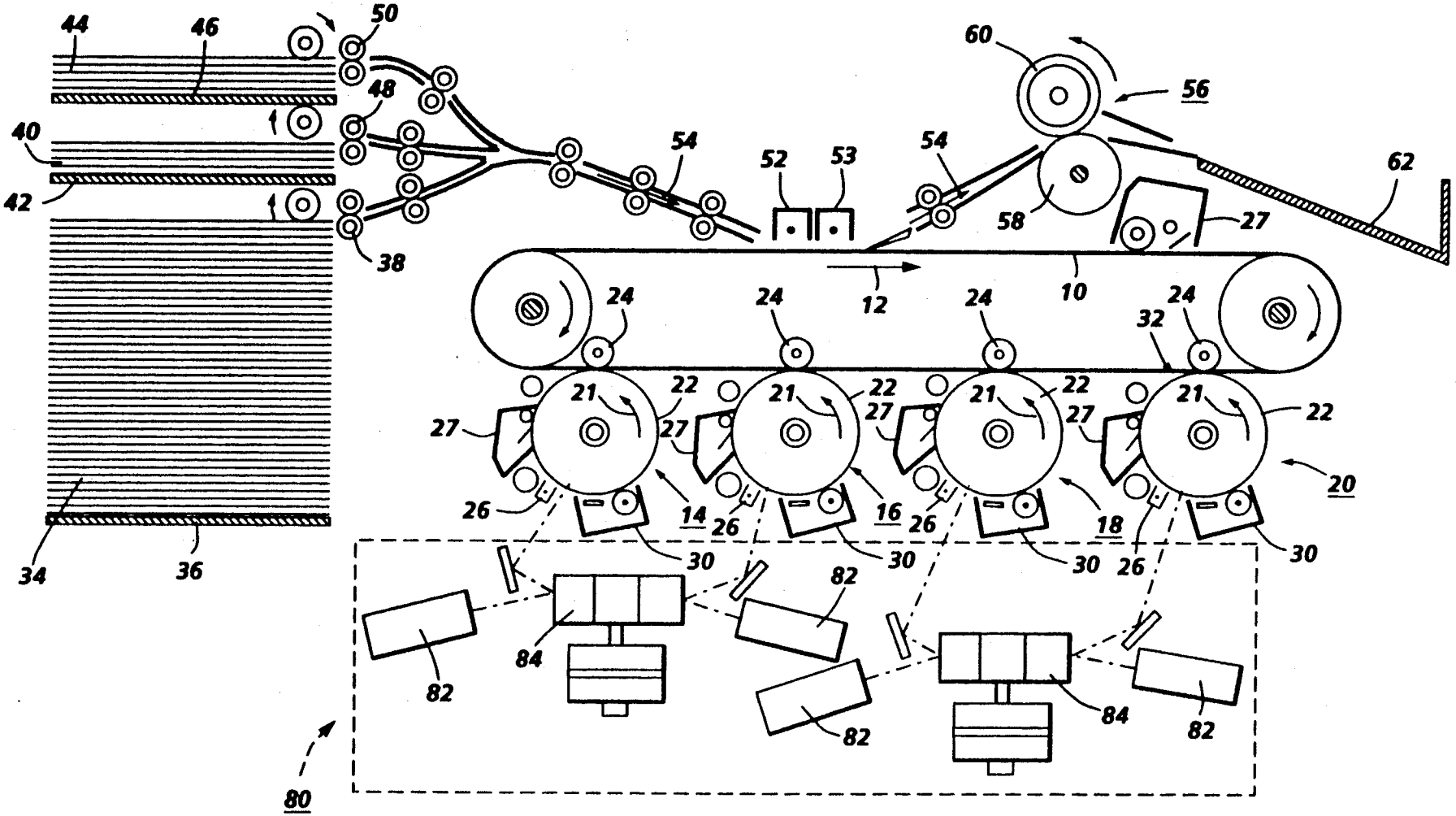

FIG. 3 is a schematic elevational view depicting an illustrative electrophotographic printing machine incorporating the photoreceptor drum runout control apparatus of the present invention therein While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention references are made to the drawings. In the drawings, like reference numerals have been used throughout to designate identical elements. Referring now to FIG. 3, an intermediate belt designated generally by the reference numeral 10 is mounted rotatably on the machine frame. Belt 10 rotates in the direction of arrow 12. Four imaging reproducing stations indicated generally by the reference numerals 14, 16, 18 and 20 are positioned about the periphery of the belt 10. Each image reproducing station is substantially identical to one another. The only distinctions between the image reproducing stations is their position and the color of the developer material employed therein. For example, image reproducing station 14 uses a black developer material, while stations 16, 18 and 20 use yellow, magenta and cyan colored developer material. Inasmuch as stations 14, 16, 18 and 20 are similar, only station 20 will be described in detail.

At station 20, a drum 22 having a photoconductive surface deposited on a conductive substrate rotates in direction of arrow 21. Preferably, the photoconductive surface is made from a selenium alloy with the conductive substrate being made from an electronically grounded aluminum alloy. Other suitable photoconductive surfaces and conductive substrates may also be employed. Drum 22 rotates in the direction of arrow 21 to advance successive portions of the photoconductive surface through the various processing stations disposed about the path of movement thereof.

Initially, a portion of the photoconductive surface of drum 22 passes beneath a corona generating device 26. Corona generating device 26 charges the photoconductive surface of the drum 22 to a relatively high, substantially uniform potential.

Next, the charged portion of the photoconductive surface is advanced through the imaging station. At the imaging station, an imaging unit indicated generally by the reference numeral 80, records an electrostatic latent image on the photoconductive surface of the drum 22. Imaging unit 80 includes a raster output scanner. The raster output scanner lays out the electrostatic latent image in a series of horizontal scan lines with each line having a specified number of pixels per inch. Preferably, the raster output scanner employs a laser 82 which generates a modulated beam of light rays which are scanned across the drum 22 by rotating a polygon mirror 84. Alternatively, the raster output scanner may use light emitting diode array write bars. In this way, an electrostatic latent image is recorded on the photoconductive surface of the drum 22.

Next, a developer unit indicated generally by the reference numeral 30 develops the electrostatic latent image with a cyan colored developer material. Image reproducing stations 14, 16 and 18 use black, yellow and magenta colored developer materials respectively. The latent image attracts toner particles from the carrier granules of the developer material to form a toner powder image on the photoconductive surface of drum 22. After development of the latent image with cyan toner, drum 22 continues to move in direction of arrow 21 to advance the cyan toner image to a transfer zone 32 where the cyan toner image is transferred from drum 22 to intermediate belt 10 by an intermediate transfer device such as a biased transfer roll 24.

At transfer zone 32, the developed powder image is transferred from photoconductive drum 22 to intermediate belt 10. Belt 10 and drum 22 have substantially the same tangential velocity in the transfer zone 32. Belt 10 is electrically biased to a potential of sufficient magnitude and polarity by biased transfer roll 24 to attract the developed powder image thereto from drum 22. Preferably, belt 10 is made from a conductive substrate with an appropriate dielectric coating such as a metalized polyester film.

After the cyan toner image is transferred to the belt 10 at reproducing station 20, belt 10 advances the cyan toner image to the transfer zone of reproducing station 18 where a magenta toner image is transferred to belt 10, in superimposed registration with the cyan toner image previously transferred to belt 10. After the magenta toner image is transferred to belt 10, belt 10 advances the transferred toner images to reproducing station 16 where the yellow toner image is transferred to belt 10 in superimposed registration with the previously transferred toner images. Finally, belt 10 advances the transferred toner images to reproducing station 14 where the black toner image is transferred thereto in superimposed registration with the previously transferred toner images. After all of the toner images have been transferred to belt 10 in superimposed registration with one another to form a multicolor toner image, the multicolor toner image is transferred to a sheet of support material, e.g., a copy paper at the transfer station.

At the transfer station, a copy sheet is moved into contact with the multicolor toner image on belt 10. The copy sheet is advanced to transfer station from a stack of sheets 34 mounted on a tray 36 by a sheet feeder 38 or from either a stack of sheets 40 on tray 42 or a stack of sheets 44 on a tray 46 by either sheet feeder 48 or sheet feeder 50. The copy sheet is advanced into contact with the multicolor image on belt 10 beneath corona generating unit 52 at the transfer station. Corona generating unit 52 sprays ions on to the back side of the sheet to attract the multicolor image to the front side thereof from belt 10. After transfer, the copy sheet passes under a second corona generating unit 53 for detack and continues to move in the direction of arrow 54 to a fusing station. The fusing station includes a fuser assembly generally indicated by the reference numeral 56, which permanently affixes the transferred toner image to the copy sheet. Preferably, fuser assembly 56 includes a heated fuser roll 58 and a backup roller 60 with the toner image on the copy sheet contacting fuser roller 58. In this manner, the toner image is permanently affixed to the copy sheet. After fusing, the copy sheets are then fed either to an output tray 62 or to a finishing station, which may include a stapler or binding mechanism.

Referring once again to reproducing station 20, invariably, after the toner image is transferred from drum 22 to belt 10, some residual particles remain adhering thereto. These residual particles are removed from the drum surface 22 at the cleaning station 27. Cleaning station includes a rotatably mounted fibrous or electrostatic brush in contact with the photoconductive surface of drum 22. The particles are cleaned from the drum 22 by rotation of the brush in contact therewith.

Belt 10 is cleaned in a like manner after transfer of the multicolor image to the copy sheet. Subsequent to cleaning, a discharge lamp (not shown) floods the photoconductive surface of drum 22 to dissipate any residual electrostatic charge remaining thereon prior to the charging thereof for the next successive imaging cycle.

It is believed that the foregoing description is sufficient for the purposes of the present application to illustrate the general operation of a tandem printing machine.

Figure 1:
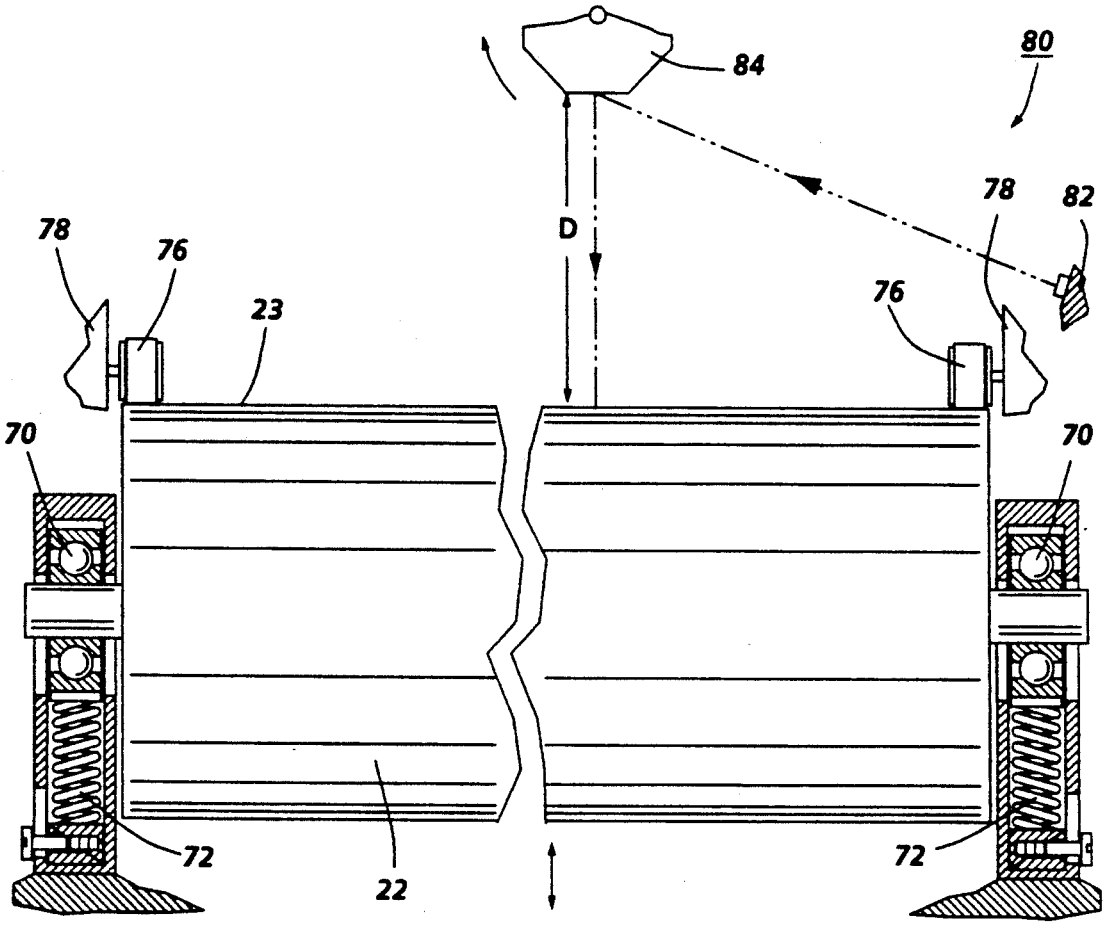
FIG. 1 is an end elevational view depicting the photoreceptor drum runout control apparatus of the present invention.
Figure 2:
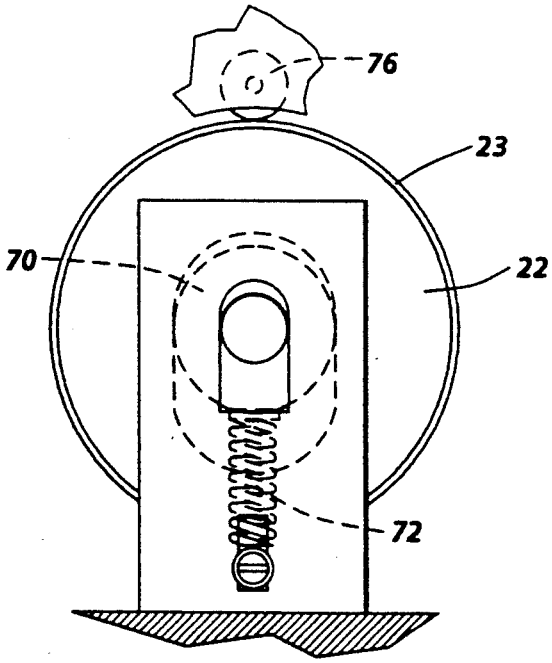
FIG. 2 is a side elevational view of FIG. 1.

Referring now to the specific subject matter of the present invention, FIGS. 1 and 2 depict the photoreceptor drum runout control apparatus in greater detail. With reference to FIG. 1, there is shown a single photoreceptor drum 22 illustrative of each of the four drums illustrated in FIG. 3. A typical imaging unit, generally indicated by reference numeral 80, including a laser 82, a polygon 84 and a modulator (not shown) is also illustrated. It is critical that the conjugate length (represented by D) between the polygon 84 and the photoreceptor surface 23 remains constant. A change in the conjugate length of the distance between the polygon 84 and the photoreceptor surface 23, causes a lateral magnification error to be introduced to the image. This is especially critical in the foregoing type of multicolor printing machine as the four different color toner images must be positioned superimposed in registration with one another. The lateral magnification error introduced by even a small amount of drum runout, which causes the conjugate length between the polygon 84 and the photoreceptor surface 23 to vary, can cause unacceptable lateral magnification error. The photoreceptor drum 22 is supported axially by bearings 70. Each of these bearings 70 is spring-biased by spring 72 so as to urge the photoreceptor drum 22 in a direction toward the scanning beam reflected by the polygon 84. Photoreceptor surface 23 is urged against guide bearings 76 mounted to the frame 78 of the machine. The photoreceptor drum 22 is constantly spring-biased so that the surface 23 is constantly riding against the guide bearings 76, causing the conjugate length D between polygon 84 and photoreceptor surface 23 to remain constant. By utilizing this configuration for each photoreceptor drum in the machine, the change in lateral magnification error on each and between successive drums is minimized.

In recapitulation, it is evident that there is provided a drum runout control apparatus which maintains a substantially constant conjugate distance between a polygon and the drum surface so as to minimize lateral magnification error. The photoreceptor drum is mounted on a rotatable supports and is resiliently urged against a guide. By urging the imaging surface of the photoreceptor drum against a rotatable guide, the imaging surface is maintained a substantially constant distance from the imaging source thereby minimizing lateral magnification error caused by drum runout.

It is, therefore, apparent that there has been provided in accordance with the present invention, a photoreceptor drum runout control apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A drum mounting apparatus, comprising:

means for guiding the drum, said guide means comprises a member mounted fixedly at a selected location so as to maintain the drum surface at a substantially constant distance from a pre-selected reference location;

means for rotatably supporting the drum; and means for resiliently urging the drum toward said guiding means to position the drum surface in contact therewith said urging means comprising a frame, and a spring mounted in said frame and engaging said supporting means to urge the drum surface into contact with said member.

2. The apparatus of claim 1, wherein said supporting means comprises a rotatable bearing supporting the drum.

3. The apparatus of claim 1, wherein said urging means contacts said supporting means to resiliently urge the drum toward said guiding means.

4. The apparatus of claim 1, wherein said member is adapted to be in rolling contact with the drum surface.

5. The apparatus of claim 1, wherein said member comprises a plurality of rotatable bearings adapted to contact the drum surface.

6. An electrophotographic printing machine having a drum mounting apparatus, comprising:

means for guiding the drum, said guide means comprises a member mounted fixedly at a selected location so as to maintain the surface thereof at a substantially constant distance from a pre-selected reference location;

means for rotatably supporting the drum; and means for resiliently urging the drum toward said guiding means to position the drum surface in contact therewith said urging means comprising a frame, and a spring mounted in said frame and engaging said supporting means to urge the drum surface into contact with said member.

7. The printing machine of claim 6, wherein said supporting means comprises a rotatable bearing supporting the drum.

8. The printing machine of claim 6, wherein said urging means contacts said supporting means to resiliently urge the drum toward said guiding means.

9. The printing machine of claim 6, wherein said member is adapted to be in rolling contact with the drum surface.

10. The printing machine of claim 6, wherein said member comprises a plurality of rotatable bearings adapted to contact the drum surface.

* * * * *